United States Patent [19]

Goffe

[11] 4,065,307

[45] Dec. 27, 1977

[54] IMAGED AGGLOMERABLE ELEMENT AND PROCESS OF IMAGING

[75] Inventor: William L. Goffe, Webster, N.Y.

[73] Assignee: Xerox Corporation, Stamford, Conn.

[21] Appl. No.: 337,614

[22] Filed: Mar. 2, 1973

Related U.S. Application Data

[62] Division of Ser. No. 862,907, Oct. 1, 1969, Pat. No. 3,753,705.

[51] Int. Cl.[2] ..... G03Q 5/02; G03Q 5/04; G03Q 5/087

[52] U.S. Cl. ..... 96/1.5 R; 96/1 PS; 96/35.1; 96/115 R; 417/145; 417/161; 428/29

[58] Field of Search ..... 96/1 R, 1 PS, 1.5, 35.1, 96/115 R, 1.1; 117/21, 93.31; 161/1, 3.5, 5, 6; 250/316, 317; 346/74 P, 74 ES, 74 EB

[56] References Cited

U.S. PATENT DOCUMENTS

| | | | |
|---|---|---|---|
| 2,739,909 | 3/1956 | Rosenthal | 250/317 X |
| 2,949,361 | 8/1960 | Agens | 96/115 R |
| 3,236,647 | 2/1966 | Phlipot | 96/35.1 X |
| 3,266,045 | 8/1966 | Schaffert | 96/1.1 X |
| 3,396,067 | 8/1968 | Schafer | 161/5 |
| 3,484,318 | 12/1969 | Neufeld et al. | 161/6 X |
| 3,515,570 | 6/1970 | Suzuki | 250/317 X |
| 3,556,781 | 1/1971 | Levy et al. | 96/1 PS |
| 3,627,619 | 12/1971 | Fromm | 161/1 X |

*Primary Examiner*—Roland E. Martin, Jr.
*Attorney, Agent, or Firm*—James J. Ralabate; James P. O'Sullivan; George J. Cannon

[57] ABSTRACT

An imaging system comprising providing an imaging member comprising an agglomerable layer in contact with an imagewise hardenable-softenable layer and imagewise hardening said member. An image is developed by imagewise softening said member to cause relative transparentizing in the imagewise softened areas due to an agglomeration of the agglomerable layer in the imagewise softened portions of said member.

11 Claims, 4 Drawing Figures

IMAGED AGGLOMERABLE ELEMENT AND PROCESS OF IMAGING

CROSS-REFERENCE TO RELATED APPLICATIONS

The application is a Divisional Application of copending application Ser. No. 862,907, filed Oct. 1, 1969, now U.S. Pat. No. 3,753,705.

BACKGROUND OF THE INVENTION

This invention relates in general to imaging and more specifically to a new migration imaging system.

There has recently been developed a migration imaging system capable of producing high quality images of high density, continuous tone and high resolution wherein migration material is caused to imagewise migrate in depth in a softenable layer, in some embodiments to deposit in image configuration on a substrate. This system is described in detail, with references to related applications, in copending application Ser. No. 725,676, filed May 1, 1968, now abandoned.

The imagewise migration in depth imaging system, while extremely advantageous in terms of simplicity and the high quality of the resulting images, does generally employ, in many of its modes, a charging step or an electrostatic latent image and an electrically insulating softenable layer and a photoconductive migration layer.

My related copending application Ser. No. 755,306, filed Aug. 26, 1968, discloses a system of providing an imaging member similar to the ones used herein but with imagewise softening of the member to cause relative transparentizing of said member in the softened areas due to an agglomeration of the agglomerable layer in the softened portion of said member.

SUMMARY OF THE INVENTION

It is an object of this invention to provide a mode of imaging, using imaging members similar to the type disclosed in aforementioned copending application Ser. No. 725,676, which eliminates the charging step and in some embodiments produces an image merely by imagewise exposure and softening of the imaging member.

It is a further object of this invention to provide an imaging system which does not require an electrically insulating softenable layer.

It is a further object of this invention to provide an imaging system which does not require use of a charged photosensitive material.

A still further object of this invention is to provide an imaging system wherein image resolution is not limited by the spreading of heat.

The foregoing objects and others are accomplished in accordance with this invention by providing an imaging member comprising an agglomerable layer contacting an imagewise hardenable softenable layer and imagewise hardening said member and then softening said member to cause relative transparentizing in the imagewise unhardened areas due to an agglomeration of the agglomerable layer in the imagewise unhardened portions of said member.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
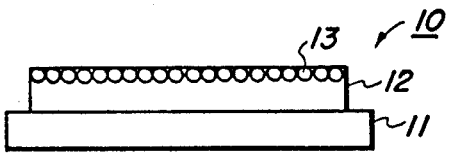
FIG. 1 represents a partially schematic drawing representing a preferred embodiment of an imaging member according to the invention.

Referring now to the Figures and in particular to FIG. 1, there is shown a schematic drawing of an example of one embodiment of an imaging member 10 according to this invention comprising substrate 11, hardenable-softenable layer 12 which contains at its upper surface agglomerable layer 13 of particulate material.

Substrate 11 may be omitted in many imaging member embodiments of this invention where the softenable layer is self-supporting but may conveniently be included as a base for coating or otherwise forming many suitable materials for softenable layer 12. Any substrate with sufficient mechanical coherence and strength to support layers 12 and 13 may be used. Electrically insulating, conductive or semi-conductive materials may be used.

The substrate of member 10 may be in any suitable form such as a strip, sheet, plate, coil, cylinder, drum, endless belt, moebius strip and the like. If desired, the substrate may be substantially transparent to allow for hardening exposure of the member from the substrate side and to permit the resultant imaged member to be viewed in transmitted light, for example to be used as a projection transparency.

Hardenable-softenable layer 12 which may comprise one or more layers of softenable materials may be any suitable material, typically a plastic or thermoplastic material, photo-hardenable material which is imagewise hardenable; for example, in the case of a photohardenable material, capable of being hardened by suitable electromagnetic radiation; the unhardened portions of which are softenable by reason of contacting with heat, a softening liquid, a softening vapor and combinations thereof and other suitable softening means to provide for the agglomerating effect and resultant transparentizing. "Softenable" as used herein to describe layer 12 is intended to mean any material which can be rendered more permeable to material or particles of layer 13 migrating substantially laterally through the bulk of layer 12. "Hardenable", on the other hand, as used herein to describe layer 12 is intended to mean any material which can be rendered less permeable to material or particles of layer 13. Hardenable-softenable layer 13 can be electrically conductive, insulating or semi-conductive.

In the embodiment hereof where layer 12 is the layer which is primarily hardened by the photohardening radiation, the material of layer 12 must, of course, also be a photohardenable material. Almost any photohardenable material conventionally used in photomechanical applications in the printing, photoengraving and related arts may be used so long as the unhardened portions of which are also softenable. Also, many thermoplastic materials which are not normally thought of as photohardenable such as Staybelite Ester 10, a partially hydrogenated rosin ester from Hercules Powder Co., more particularly described in U.S. Pat. No. 3,307,941 to Gundlach may be imagewise hardened when exposed to hardening radiation.

Typical substantially electrical insulating hardenable-softenable thermoplastics similar to Staybelite Ester 10, include Foral Ester, a hydrogenated rosin triester, and Neolyne 23, an alkyd resin, all from Hercules Powder Co.; SR type silicone resins available from General Electric Corporation; Sucrose Benzoate, Eastman Chemical; Velsicol X-37, a polystyrene-olefin copolymer from Velsicol Chemical Corp.; Hydrogenated Piccopale 100, Piccopale H-2, highly branched polyolefins, Piccotex 100, a styrene-vinyl toluene copolymer, Piccolastic A-75, 100 and 125, all polystyrenes, Piccodiene 2215, a polystyrene-olefin copolymer, all from Pennsylvania Industrial Chemical Corp.; Araldite 6060 and 6071, epoxy resins from Ciba; R5061A, a phenylmethyl silicone resin, from Dow Corning; Epon 1001, a biphenol A-epichlohydrin epoxy resin, from Shell Chemical Corp.; and PS-2, PS-3, both polystyrenes, and ET-693, a phenolformaldehyde resin, from Dow Chemical; custom synthesized copolymers of styrene and hexylmethacrylate, a custom synthesized polydiphenylsiloxane; a custom synthesized polyadipate; acrylic resins available under the trademark Acryloid from Rohm & Haas Co., and available under the trademark Lucite from the E. I. duPont de Nemours & Co.; thermoplastic resins available under the trademark Pliolite from the Goodyear Tire & Rubber Co.; a chlorinated hydrocarbon available under the trademark Aroclor from Monsanto Chemical Co.; thermoplastic polyvinyl resins available under the trademark Vinylite from Union Carbide Co.; other thermoplastics disclosed in Gunther et al U.S. Pat. No. 3,196,011; waxes and blends, mixtures and copolymers thereof.

Typical conductive softenable materials include Ethocel, an ethyl cellulose material from Dow Chemical Co.; polyxylene adipate, polyhexamethylene sebacate, polyvinyl alcohol, polyvinylbenzyltrimethyl ammonium chloride and others.

The photohardenable characteristics of the above materials may be enhanced by mixing known photopolymers with the above described hardenable-softenable materials, for example, as described in Gundlach, U.S. Pat. No. 3,307,941.

The photohardenable materials disclosed in Gundlach, U.S. Pat. No. 3,307,941, namely, the cinnamate esters of polyvinyl alcohol and/or cellulose which may be further sensitized by the presence of anthrones and their derivatives, polynuclear quinone derivatives and certain ketones such as Michler's Ketone and which are commercially available under the trademarks Kodak Photoresist (KPR), KMER and KOR from the Eastman Kodak Co. are found to be preferred photohardenable materials for use herein because when combined with many hardenable-softenable thermoplastics, such as Staybelite Ester 10, a material is produced which is preferred in this invention i.e., a material which in layer form is both imagewise hardenable and softenable in the unhardened areas.

However, any suitable photohardenable material may be used. Typical photohardenable materials are systems comprising a non-photosensitive polymer and a photosensitive low molecular-weight compound with which it is capable of reacting on exposure to produce insolubility typified by polymeric materials such as casein and rubber, in combination with photosensitive azidistilbene sulfonate derivatives; systems comprising a monomer, a dimer and/or a low-molecular weight polymer with a filler and one or more polymerization catalysts typified by materials as described in Plambeck U.S. Pat. Nos. 2,760,863 and 2,791,504; systems comprising a non-photosensitve polymer and photosensitive low-molecular weight compounds wherein the photosensitive agent reacts with itself on exposure to create insolubility in exposed portions typified by ethylcellulose, polymethyl methacrylate and numerous other commercial plastics containing photosensitive chalcone or unsaturated ketone derivatives typified by materials as described in Murray U.S. Pat. No. 1,965,710 and Van Deusen U.S. Pat. No. 2,544,905; systems of chromate compounds in colloids such as gelatin, albumen and glue or protein colloids sensitized, for example, with potassium bichromate or cellulose derivatives sensitized, for example, with ammonium dichromate or other polyvinyls such as polyvinylalcohol, polyvinylacetal, polyvinyl methyl ether and polyvinylpyrrolidone sensitized for example with ammonium dichromate or polyamides sensitized by dichromates; diazo-sensitized materials and others.

The above groups of photohardenable and softenable materials are not intended to be limiting but merely illustrative of materials suitable for imagewise hardenable-softenable layer 12. Layer 12 may be of any suitable thickness. The primary determination in this regard is that the thickness of softenable layer separating the agglomerable layer from the softening agent be sufficiently thin to permit softening agents such as softening vapor or heat to permeate or be effectively transferred by the softenable layer to the agglomerable layer to cause the transparentizing effect of this invention. In this regard, imaging members with softenable layer thicknesses of about 3 microns have been softened by infra red radiation, through the rear i.e., from the substrate 11 side, the substrate constituting an aluminized 3 mil thick Mylar polyester terephthalate film from duPont where the aluminum layer was about 50% transmissive of visible light to cause the transparentizing imaging effect of this invention. Radiation exposure softening may take place through even thicker softenable layers, especially where the material of the layer is not an effective absorber of that radiation being used, but layer 13 is.

Imagewise hardening of layer 12 can also be accomplished by deposition of plastic materials which contact the particles of layer 13 directly or contact the particles by slight mixing with the softenable layer. For example, the hardenable-softenable layer is first treated with vapors which soften it and then contacted in an imagewise pattern with a powder comprising finely divided polystyrene pigmented with carbon black. The layer is then heated to about 100° C for about 3 seconds whereupon the agglomerable layer agglomerates in the areas not covered by the powder. Imagewise hardening of layer 12 can also be accomplished by exposing the layer to imagewise radiation of nuclear particles or electrons.

It will be appreciated that typically the softening step of this invention will be a uniform exposure to softening agents or agent over the area of the imaging member desired to be imaged to provide for uniform resultant image characteristics.

The Figures show the preferred positioning of layer 13 relative to softenable layer 12, where layer 13 is embedded in the softenable layer 12 but spaced apart from any substrate 11. This imaging member makeup provides for optimum imaging efficiency. However, imaging according to this invention can be done with agglomerable layer 13 actually touching the softenable layer 12 substrate 11 interface. Thus, layer 13 may be located on or at any place in layer 12.

Layer 13 may comprise any suitable agglomerable material including electrical insulators, electrical conductors, photoconductive materials and non-photoconductive materials. The agglomerable material can be opaque or light-scattering transparent or translucent material.

Agglomerable and the several variant forms thereof used herein defines the effect of substantial massing or fusing together of the imagewise unhardened, softened portions of layer 13 to greatly reduce the cross-sectional area and transparentize or effect a color change of layer 13 in said areas, the color change associated with the light scattering caused, for example, by the particles in the imaged areas of a particle layer 13 (see copending application 725,676), now abandoned which may be accompanied by some dispersing of individual portions or particles of layer 13 in depth in layer 12 which produce additional transparentizing and color changes; specifically including the massing together of closely packed particles into a smaller number of larger spheres of less total surface area.

In fact, greater sensitivities may be obtained for color changes as opposed to a change to near neutral density. For example, an image is very pronouncedly different from the color of the background (for example a purple image in a yellow-orange background) may give substantially greater contrast density for the same softening than a change to a near neutral density in a yellow-orange background.

Preferred agglomerable materials for use herein, because of the excellent quality of the resultant images and because of the sensitivity of the system include: crystalline selenium, amorphous selenium, amorphous selenium alloyed with various materials such as arsenic, tellurium, antimony, bismuth, etc.; amorphous selenium or its alloys doped with halogens; tellurium and mixtures of amorphous selenium and one or more crystalline forms of selenium including the monoclinic and hexagonal forms. An optimum agglomerable material comprises predominantly, greater than 50% by weight, amorphous selenium.

It is found that especially suitable materials for layer 13 especially in the preferred radiation exposure mode hereof, have a low glass transition temperature i.e., generally below about 50° or 60° C and a high absorption coefficient in the visible, such as selenium.

Any suitable agglomerable material may be used in layer 13. Typical additional agglomerable materials include sulfur, dyed polyvinyl carbazole and others.

Agglomerable layer 13, portions of which laterally migrate during imagewise softening, is shown to be a microscopically discontinuous layer of closely packed particles. It is preferred for images of highest resolution, density and utility and to provide for the most sensitive system that layer 13 be a microscopically discontinuous layer and optimally that the layer 13 be particulate in order to best promote the agglomerating effect of this invention. However, layer 13 taking the form of a Swiss cheese pattern or even a completely continuous thin layer will work.

For optimum results layer 13 is preferably from about 0.1 to about 1 micron thick although about 0.05 to about 5 micron layers have been found to give images according to this invention.

Optimum layers in this regard are thin, optimally between about 0.1 and about 0.5 micron thick microscopically discontinuous layers comprising predominantly amorphous selenium, for example, vacuum evaporated by techniques as disclosed in copending application Ser. No. 423,167, filed Jan. 4, 1965. Microscopically discontinuous layer 13 may also be formed by other methods such as cascading, dusting, etc. as shown in copending application Ser. No. 460,377, filed June 1, 1965, now U.S. Pat. No. 3,520,681 or by stripping and other methods as described in copending application Ser. No. 685,536, filed Nov. 24, 1967, now abandoned, or any other suitable method. If thicker coatings are desired, layer 12 may be softened slightly by heating, for example, to permit particles deposited on its surface to seat themselves, i.e., to embed a short distance into the plastic after which additional particles may be cascaded across or dusted over the softenable layer 12.

Especially suitable selenium films when viewed under a microscope show either a network of cracks or apertures or else a network of dark lines indicating a microscopically discontinuous layer. Electron micrographs show that optimum predominantly amorphous selenium films are actually composed of discrete spherical amorphous particles of an average particle size preferably between about 0.1 and about 0.5 microns.

While the layered configuration as described and illustrated is preferred, the binder structure where agglomerable particles are dispersed in the softenable layer may also be used and is specifically intended to be included in the claim language "an imaging member comprising an agglomerable layer contacting a softenable layer." Preferred particle/binder ratios are found to be between about 1/1 to about 1/3 and preferred binder layer thicknesses are generally less than about 5 microns to give good resolution. It will be appreciated that the binder layer may be placed on a softenable layer or sandwiched between softenable layers to create an imaging member much thicker than the 5 micron maximum which is preferred for the binder part of the overall structure. Further information on the makeup of binder layers for use herein is found in copending application Ser. No. 634,757, filed Apr. 28, 1967, now abandoned.

The imaging members hereof are imaged by imagewise hardening preferably optically as by exposing to an image pattern of hardening radiation such as UV radiation and softening preferably by uniformly exposing the member to softening radiation, contacting with a softening liquid or vapor, heat and combinations thereof and other suitable softening means.

Figure 2:
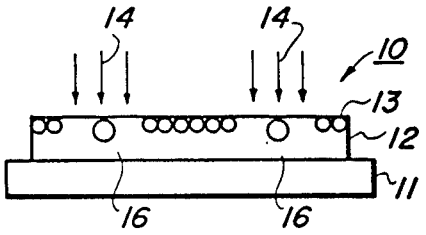
FIG. 2 shows the imaging member of FIG. 1 being imagewise hardened in a preferred mode hereof by reason of exposure to hardening radiation for either or both of layers 12 and 13.

Referring now to FIG. 2, the preferred mode of imagewise hardening, because of its simplicity and because of the good images produced, comprises exposing the members hereof to an image pattern of hardening radiation 14 preferably ultra violet radiation, such as radiation of a wavelength between about 1800 and 4,000 angstrom units, typically by any suitable conventional projection technique. Radiation of a wavelength above about 4,000 angstrom units can be employed, but the intensity is reduced to avoid particle fusion in the agglomerable layer.

Figure 3:
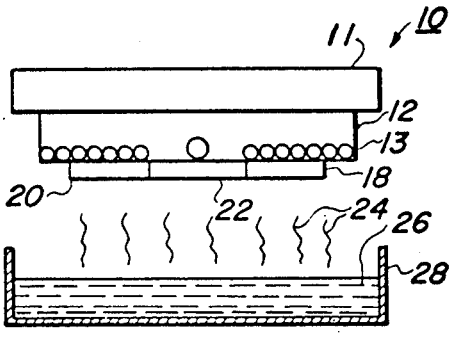
FIG. 3 shows the imaging member of FIGS. 1 and 2 being softened by exposure to a softening vapor with resultant transparentizing in the softened areas.

Referring now to FIG. 3, member 10 is exposed to vapors 24 of solvent 26 in container 28 to cause imagewise agglomeration and transparentization in softened area 16 which are also those areas which were not photohardened by photohardening radiation 14 as shown in FIG. 2 to cause imagewise agglomeration and transparentization in the softened areas 16.

It is seen that agglomeration causes reduction of surface area of layer 13 by the formation of larger spheres 17 of the same mass as the total mass of the agglomerated smaller particles of layer 13 but with a smaller surface area than the total of the surface areas of the agglomerated smaller particles.

Since it is thought that the agglomeration hereof is typically accompanied by at least some softening of both layers 12 and 13 to allow the particles to drift together, wet each other, and permit the reduction of surface area of the material comprising layer 13, there are several process variations of imaging. Typical combinations are:

a. layer 12 may comprise a relatively thin photohardenable material touching the particles over another material which need not be softenable or imagewise hardenable; and b. the particles of layer 13 themselves may be photohardenable rather than the material of layer 12.

When radiation heat softening is used, the agglomerating effect may result from radiation absorption by substrate 11, layer 12, layer 13 or combinations thereof. For example, substrate 11 may be exposed with conduction and convection transferring the heat to layers 12 and 13 to cause the agglomerating effect hereof.

Uniform infra red irradiation greater than about 0.2 watts/square mm. have been found to produce acceptable quality images.

Figure 4:
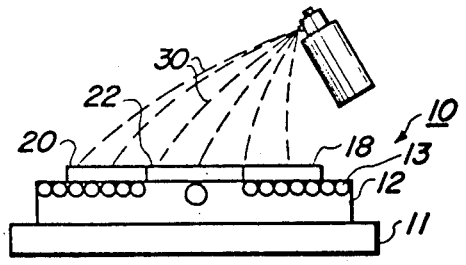
FIG. 4 shows the imaging member of FIGS. 1 and 2 being softened by exposure to a softening liquid with resultant transparentizing in the softened areas.

FIG. 4 shows a liquid in the form of a spray 30 being uniformly applied to contact and soften layers 12 and 13 as an alternative method of softening layers 12 and 13. Heating layers 12 and 13 to soften them is another alternative method of softening or the heating step may be used in conjunction with vapor or liquid treatment. The following Examples further specifically define the present invention with respect to the imaging system of this invention. The parts and percentages are by weight unless otherwise indicated. The Examples below are intended to illustrate various preferred embodiments of the imagewise hardening and uniform softening imaging system of this invention.

EXAMPLE I

An imaging member such as that illustrated in FIG. 1 is prepared by first dissolving about 5 parts of Staybelite Ester 10 in about 20 parts of cyclohexanone and about 75 parts toluene. Using a gravure roller the solution is then roll coated onto about a 3 mil Mylar polyester film having a thin semi-transparent aluminum overcoating, the aluminum coating about 50% visible light transmissive. The coating is applied so that when air dried for about 2 hours to allow for evaporation of the cyclohexanone and toluene solvent, about a 2 micron thick layer of Staybelite Ester is formed on the aluminized Mylar. A thin layer of particulate amorphous selenium approximately 0.5 microns in thickness and comprising spheres about 0.5 microns in diameter is then deposited contiguous on the Staybelite surface by vacuum deposition utilizing the process set forth in copending application Ser. No. 423,167, filed Jan. 4, 1967 incorporated herein by reference.

The imaging member is photohardened by laying an imagewise optical mask on layer 13 and then exposing the member from the layer 13 side to ultraviolet radiation from a high pressure quartz mercury vapor arc lamp manufactured by the Hanovia Lamp Div. of Englehard Industries, Newark, New Jersey at a power input of about 100 watts, and about 1.2 amps, the lamp held about 10 inches from the surface of the member, the exposure duration being for about 10 seconds. The lamp transmits the complete UV spectrum from about 1800 to about 4000 angstrom units.

The imaging member is then uniformly exposed to the vapors of 1,1,1-trichloroethane emanating from a small mouth gallon jug with the bottom covered with solvent, for about 10 seconds. The member is then placed on a hotplate with the hotplate contacting the substrate and heated at about 100° C for about 3 seconds to cause agglomeration and relative transparentization of the imaging member in those areas of the member which were not exposed to UV radiation.

The imaged member exhibits a resolution of about 20 line pairs/millimeter with a contrast density of about 1.5. The imaged member is then inserted into a slide projector and an image focused on a viewing screen to give a dark image in a lighter background, the dark image corresponding to the cut out portion of the optical mask used in the ultraviolet exposure step.

EXAMPLE II

The procedure of Example I is repeated except that the Staybelite Ester is replaced by a styrene-vinyl toluene copolymer available from the Pennsylvania Industrial Chemical Co. as Piccotex 100. An image of comparable quality to that obtained in Example I is produced.

Although specific components and proportions have been stated in the above description of preferred embodiments of the imaging system of this invention, other suitable materials as listed herein may be used with similar results. In addition, other materials which presently exist or may be discovered may be added to the materials used herein and variations may be made in the various processing steps to synergize, enhance or otherwise modify the properties of this invention. For example, particles of the agglomeration layer 13 may consist of more than one particle, for example, coloring material such as dyes or pigments in a resin binder. Also, although the material of layer 13 is opaque in many embodiments, it need not be opaque. Clear or colorless material may still show a substantially reduced projection light scattering effect in agglomerated areas to produce satisfactory transparencies according to the invention. Also, although agglomeration has been spoken of as producing its most prominent transparentizing effect, the imagewise agglomeration hereof may produce a variety of color changes in a member which can then be directly observed or used as a projection transparency; and transparentizing and the variant forms thereof used herein is specifically intended to include these color changes.

Temporary softening as opposed to irreversible softening is sufficient to cause agglomerization hereof and is usually preferred to provide a self-fixing mechanism. Hard overcoatings and other fixing techniques will occur to those skilled in the art.

It will be appreciated that when a substrate 11 is used, it may be a substantial absorber of heating radiation and cause indirect heating of layer 13 and softenable material by convection and conduction from the substrate.

It will be understood that various other changes in the details, materials, steps and arrangements of parts which have been herein described and illustrated in order to explain the nature of the invention will occur to and may be made by those skilled in the art upon a reading of this disclosure and such changes are intended to be included within the principle and scope of this invention.

What is claimed is:

1. An imaged member comprising a softenable layer, an image configuration of agglomerable material in a relatively unagglomerated condition relative to a complementary image pattern comprising larger agglomerates, the relatively unagglomerated image pattern and the agglomerated complementary image pattern being located at the same level in depth in the softenable layer, the softenable layer in the unagglomerated image area being harder and corresponding portions of the imaged member being relatively less transparent than the portions of the imaged member corresponding to the agglomerated complementary image pattern areas.

2. An imaged member according to claim 1 wherein the thickness of said softenable layer is less than about 5 microns.

3. An imaged member according to claim 1 wherein the thickness of the agglomerable layer in the unagglomerated areas is between about 0.5 and about 5 microns thick.

4. An imaged member according to claim 3 wherein the thickness of the agglomerable layer in the unagglomerated areas is between about 0.1 and about 1 micron thick.

5. An imaged member according to claim 1 wherein the agglomerable layer in the unagglomerated area is a microscopically discontinuous layer.

6. An imaged member according to claim 5 wherein the agglomerable layer in the unagglomerated area is composed of closely packed particles.

7. An imaged member according to claim 6 wherein the particles comprise predominantly selenium.

8. An imaged member according to claim 7 wherein the particles comprise predominantly amorphous selenium.

9. An imaged member according to claim 8 wherein the average diameter of said particles in the unagglomerated areas is between about 0.1 and about 0.5 microns.

10. An imaged member according to claim 1 wherein said agglomerable material comprises predominantly selenium.

11. An imaged member according to claim 7 wherein said agglomerable material comprises predominantly amorphous selenium.

* * * * *